US007344457B2

(12) United States Patent
Liberatore

(10) Patent No.: US 7,344,457 B2
(45) Date of Patent: Mar. 18, 2008

(54) RETENTION OF WEIGHTING ON ATHLETIC STRIKER

(76) Inventor: Raymond A. Liberatore, 12143 Punkin Hollow Rd., Bentonville, AR (US) 72712

( * ) Notice: Subject to any disclaimer, the term of this patent is extended or adjusted under 35 U.S.C. 154(b) by 0 days.

(21) Appl. No.: 10/393,697

(22) Filed: Mar. 20, 2003

(65) Prior Publication Data

US 2003/0232668 A1 Dec. 18, 2003

Related U.S. Application Data

(63) Continuation-in-part of application No. 10/262,734, filed on Oct. 1, 2002, now abandoned.

(51) Int. Cl.
*A63B 69/00* (2006.01)

(52) U.S. Cl. ..... 473/457; 473/422; 473/431

(58) Field of Classification Search ..... 473/422, 473/437, 457, 519, 520, 558–568, 256, 231; 482/105–107

See application file for complete search history.

(56) References Cited

U.S. PATENT DOCUMENTS 1,026,990 A * 5/1912 Matson ..... 473/519
2,676,803 A 4/1954 Damaske
3,521,883 A 7/1970 Hamilton
3,593,769 A 7/1971 Spears
3,606,327 A * 9/1971 Gorman ..... 473/297
3,623,724 A 11/1971 Lande
4,000,893 A 1/1977 Evans
4,588,191 A 5/1986 Stewart
4,621,808 A * 11/1986 Orchard et al. ..... 482/105
4,671,510 A * 6/1987 Schoenwetter ..... 473/437
4,842,280 A 6/1989 Hilton
5,050,877 A 9/1991 Wales
5,403,009 A 4/1995 Gleason, Jr.
5,484,156 A 1/1996 Giguere
5,888,154 A * 3/1999 Hartman ..... 473/457
5,980,397 A * 11/1999 Hart et al. ..... 473/437
6,010,415 A 1/2000 Miggins
6,093,114 A 7/2000 Haringa
6,102,810 A * 8/2000 Boland ..... 473/256
6,419,591 B1 * 7/2002 Addeo et al. ..... 473/256
6,533,685 B1 * 3/2003 Otten et al. ..... 473/437

* cited by examiner

*Primary Examiner*—Mitra Aryanpour
(74) *Attorney, Agent, or Firm*—Myers Wolin, LLC

(57) ABSTRACT

Apparatus to add weight to an athletic ball striking bat, having a taper along the bat length, comprising in combination a sleeve sized to extend about the bat at the taper location, the sleeve having associated retention means to engage the bat at a zone along said taper to resist lengthwise removal of the sleeve off the bat during bat swinging, a weight or weights carried by the sleeve.

19 Claims, 13 Drawing Sheets

10a
10
14
13
11
15
20
10b
20
116
10c

RETENTION OF WEIGHTING ON ATHLETIC STRIKER

BACKGROUND OF THE INVENTION

This application is a continuation-in-part of Ser. No. 10/262,734 filed Oct. 1, 2002 now abandoned.

This invention relates generally to swinging of ball strikers, as for example baseball bats; more particularly it concerns practice or warm-up swinging of such strikers or bats having weight added to them.

When athletes who handle ball strikers warm-up, or train, they commonly use two strikers, and swing them in unison a few times to loosen muscles. Holding and swinging two strikers is awkward, uncomfortable, and does not achieve the right feel, needed as by gripping and swinging only one striker but one striker does no achieve additional weight as can be provided by two strikers. There is a need to overcome this dilemma, in a simple, yet effective and efficient manner, as is now provided by the present invention. In a similar manner, there is a need to provide improvements with respect to devices for adding weights to ball strikers such as baseball bats, for example.

There is also a need for a weight holding device that can be easily attached to and removed from a bat, and which positively and safely retains the added weight to the bat.

SUMMARY OF THE INVENTION

It is a major object of the invention to provide a simple and effective device or apparatus that meets the above need. Basically, the device is adapted for use in a ball striker or bat having a taper or tapered surface, along its length, and includes:

a) a sleeve sized to extend about the bat at the taper location, b) the sleeve having associated retention means to operatively engage the bat at a zone along said taper to resist lengthwise removal of the sleeve off the bat during bat swinging, c) a weight or weights carried by the sleeve.

As will be seen, the weight or weights are typically carried at a location or locations proximate the ball striking zone; and the retention means is spaced from the weight or weights, and has an arcuate interior surface to arcuately engage the bat at arcuately spaced locations.

It is a further object to enable bat reception through the sleeve, so that the bat handle projects from the sleeve, the engaged zone of the bat typically located between the handle and weight or weights. The latter may be located in a pocket or pockets formed by or attached to the sleeve.

An added object is to provide the retention means to include a retainer at the inner side of the sleeve, and which has an inner surface to engage the bat taper, such inner surface having a configuration defined by one of the following i) generally cylindrical ii) tapered, lengthwise of the sleeve A yet further object is to provide a first pulling device on the sleeve to enable manual pulling of the sleeve endwise along the bat during close fitting assembly of the sleeve to the bat. A second pulling device may be provided on the sleeve to enable manual pulling of the sleeve endwise along and off the bat. Such devices may comprise pullers such as loops projecting at the sleeve exterior.

Another object is to provide the weight or weights to comprise a deformable mass or masses of surface configuration, at or proximate the bat "sweet spot".

An added object is to provide a retainer having an inner surface characterized by at least one of the following:

i) conical shape ii) tapered iii) cylindrical iv) consisting of metal v) consisting of non-metal vi) consisting of plastic Another aspect of the invention concerns provision of a method of use of the sleeve as described, in any of its forms, that includes i) relatively advancing the sleeve in a first direction onto the bat to position the associated retention means at or along the bat taper, ii) practice swinging the bat, iii) and subsequently relatively retracting the sleeve off the bat in a second direction opposite the first direction.

That method may include use of deformable weight or weights carried by the sleeve in spaced relation to the retainer, as well as the step of allowing said weight or weights to deform during bat swinging.

These and other objects and advantages of the invention, as well as the details of an illustrative embodiment, will be more fully understood from the following specification and drawings, in which:

DRAWING DESCRIPTION

Figure 27:
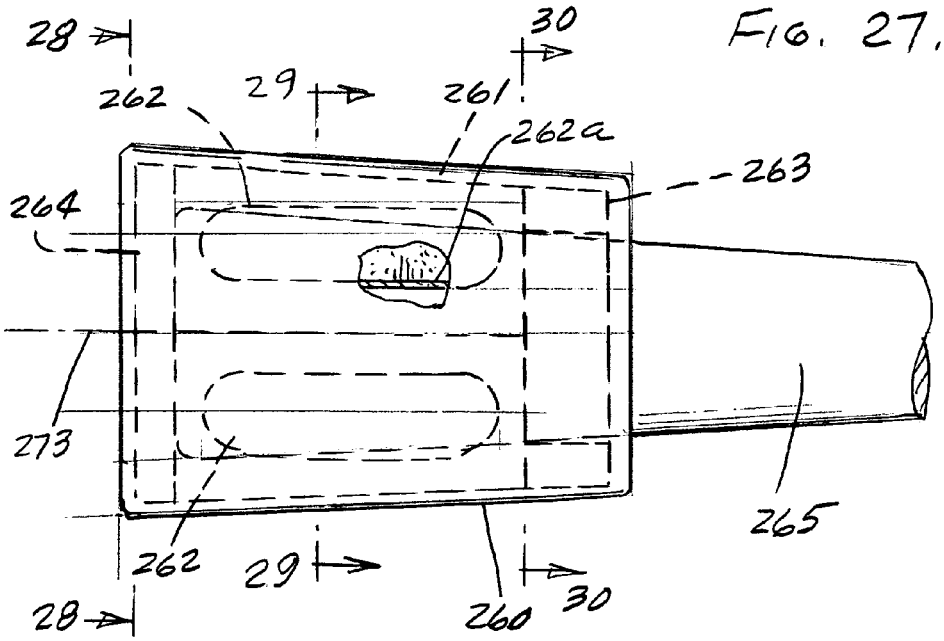
Figure 28:
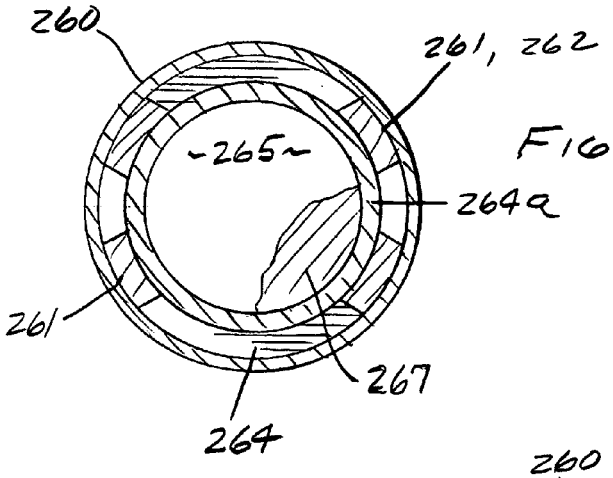
Figure 29:
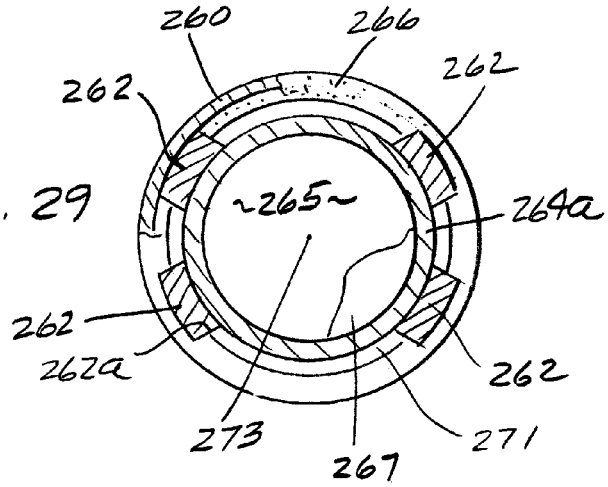
Figure 30:
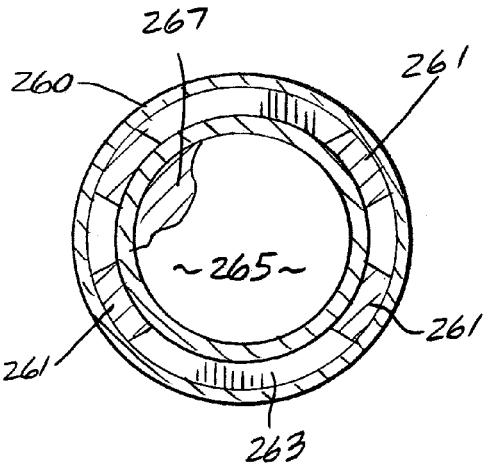

FIGS. 28, 29 and 30 are sections taken on lines 28-28, 29-29 and 30-30- in FIG. 27.

DETAILED DESCRIPTION

Figure 1:
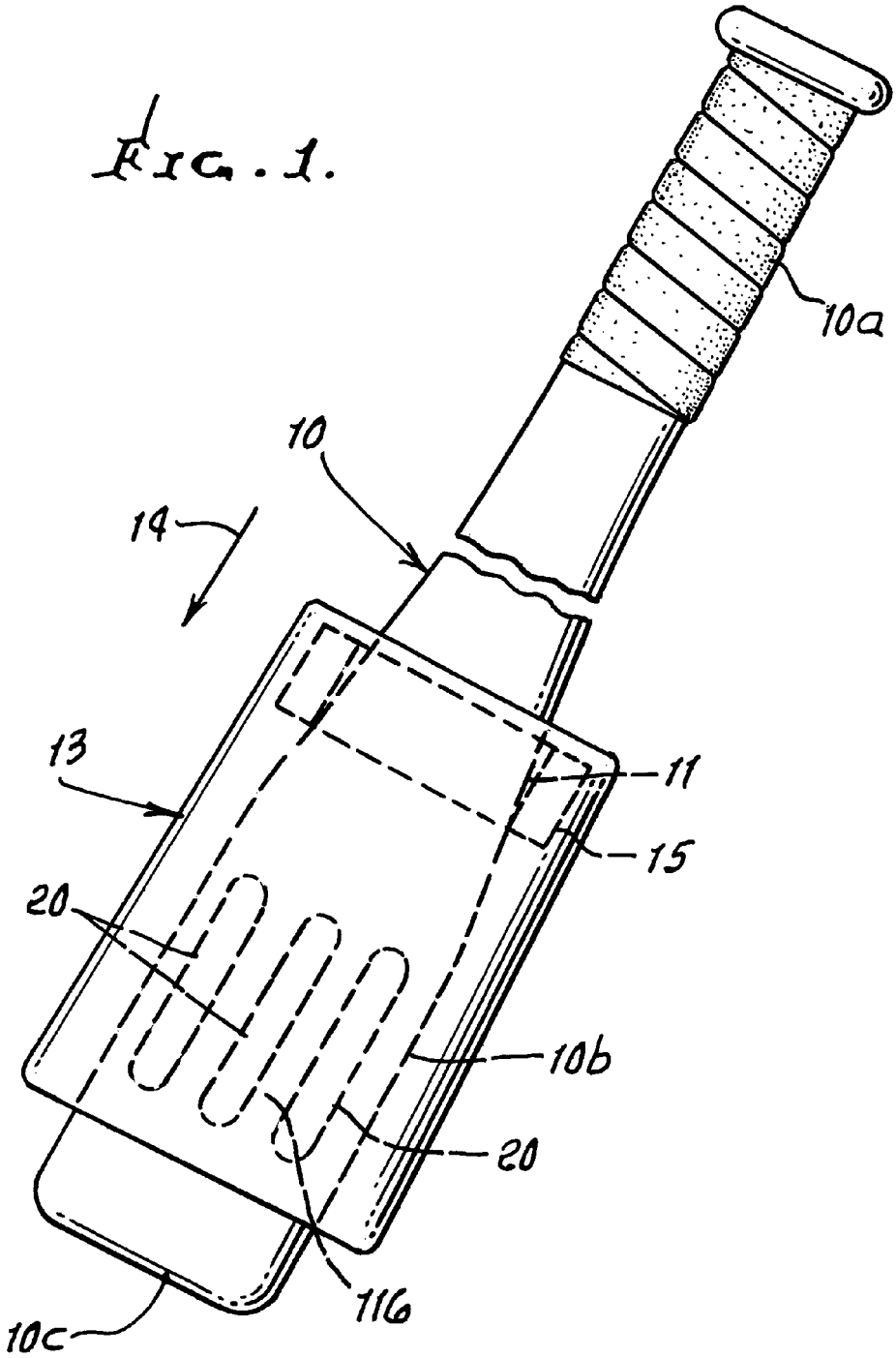
FIG. 1 is a front side elevation showing an elongated sleeve-type receptacle receiving a ball striker such as a baseball bat.

Referring to FIG. 1, an athletic ball striker, in the form of a bat 10 has a surface taper along its length, in region 11.

That taper may be defined by a conical section of the bat, between handle 10*a*, and the bat sweet spot or region 10*b*. The forward end of the bat is seen at 10*c*.

A sleeve 13 is provided and sized to be received endwise on the bat, in direction 14. As shown, its assembly onto the bat is arrested in the sleeve position shown, extending about taper region 11, as well as about the sweet spot region 10*b*. The sleeve may for example consist of flexible plastic material.

Figure 14:
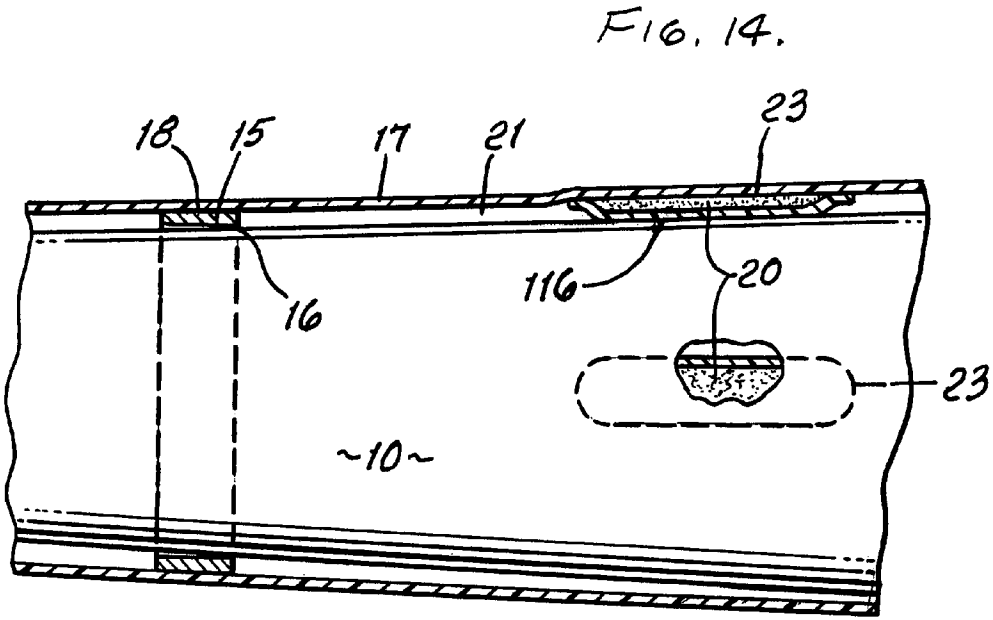
FIG. 14 is a section taken through a sleeve assembled to a bat, and showing retainer and weight positioning.
Figure 15:
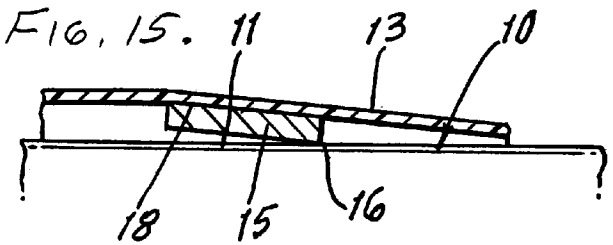
FIG. 15 is an enlarged view of the retainer seen in FIG. 14.

The sleeve has associated retainer means to engage the bat, at taper region 11, and to resist lengthwise removal of the sleeve off the bat, in direction 14. That retainer means may take the form of an annular retainer ring indicated at 15. FIGS. 14 and 15 show the retainer engaging the bat tapered surface, at 16, with interference to resist further forward movement along the bat. The sleeve 17 is attached to the retainer, or carries the retainer as at 18, so that the sleeve is likewise retained against further forward movement on and along the bat. The attachment 18 may be a bond, or the retainer may be mechanically attached to the sleeve, as by a fastener or fasteners. Sleeve material may extend between the retainer and bat.

Figure 16:
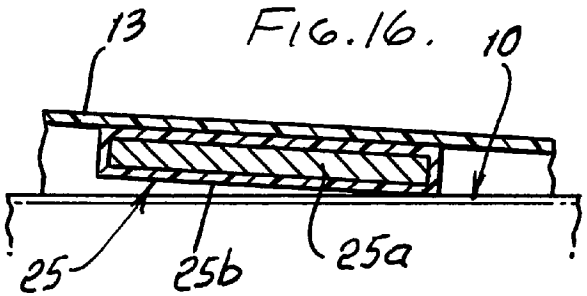
FIG. 16 is an enlarged view of a modified retainer, of the type shown in FIG. 15.
Figure 17:
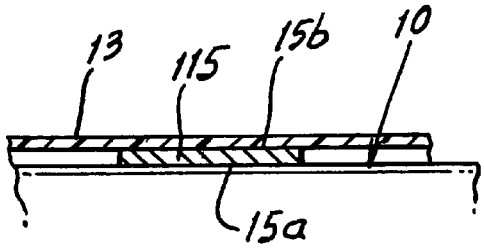
FIG. 17 is a view like FIG. 15, but showing a conical retainer.
Figure 18:
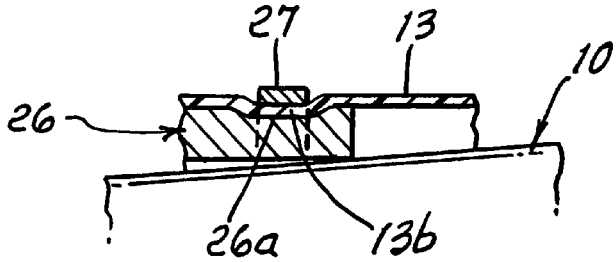
FIG. 18 is a view showing a modified form of sleeve attachment retainers and FIG. 19 is a view of a modified sleeve, retainer and weight structure.

Retainer 115 is shown in FIG. 17 as generally conical, and as having conical inner and outer surfaces 15*a* and 15*b*. FIG. 16 shows the modified retainer 25 as comprising an annular ring 25*a* and having a coating 25*b* on it, such as a plastic coating, serving to engage the bat surface without scoring it. FIG. 18 shows a retainer 26 in the form of a ring, and having an annular recess 26*a*. A clamping ring 27 extends about recess 26*a*, and clamps a portion 13*b* of the sleeve into the recess, to secure the sleeve to the retainer 26.

The sleeve 13 in FIGS. 1 and 14 carries a weight or weights 20, spaced forwardly of the retainer 15 at location 116. See space 21 in FIG. 14. That space may be of selected length, and may be almost eliminated to place the weights very near the retainer; however, as shown, the retainer 15 is located between location 116 and the bat handle. That weight or weights may consist of a mass of deformable material such as metallic granules contained in a pocket or pockets 23 (see in FIG. 14) integral with the sleeve. Such pockets hold the granules in close conformity to the bat surface at location 116, and the pockets may themselves be flexible to enhance such conformity, so that the bat overall configuration remains generally the same, whether or not the sleeve is applied and retained. This may be promoted by forming the pockets in elongated, narrow configuration, and spaced about the bat as indicated by the weight locations seen in FIG. 1. The weights are preferably located adjacent region 116. The pockets may be sewn to the sleeve.

Figure 2:
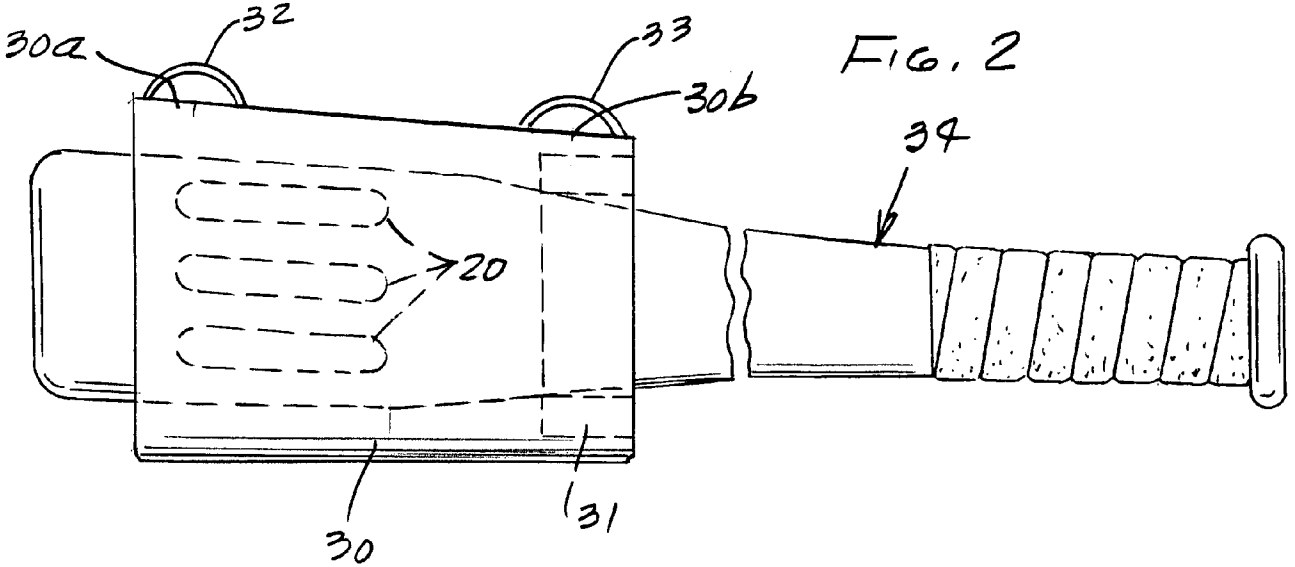
FIG. 2 is a view like FIG. 1, showing a modification.
Figure 3:
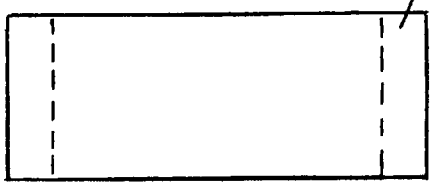
FIGS. 3 and 4 are side views of two types of retainers usable in the sleeve of FIGS. 1 and 2.
Figure 4:
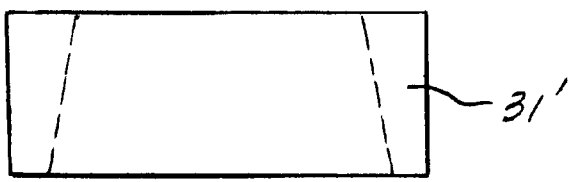

FIG. 2 shows a sleeve 30 received on bat, and held against forward dislodgement by annular retainer 31. A first device, such as loop 32 is provided on or attached to the sleeve forward side portion 30*a* for enabling manual pulling of the sleeve forwardly along the bat during assembly. A second device, such as loop 33, is provided on or attached to the sleeve rearward side portion 30*b*, for enabling manual pulling of the sleeve rearwardly along the bat, during disassembly off the bat 34. FIG. 4 shows the conical retainer 31', similar to 115 and FIG. 3 shows a modified retainer 32', in the form of a cylinder, similar to 15.

Figure 5:
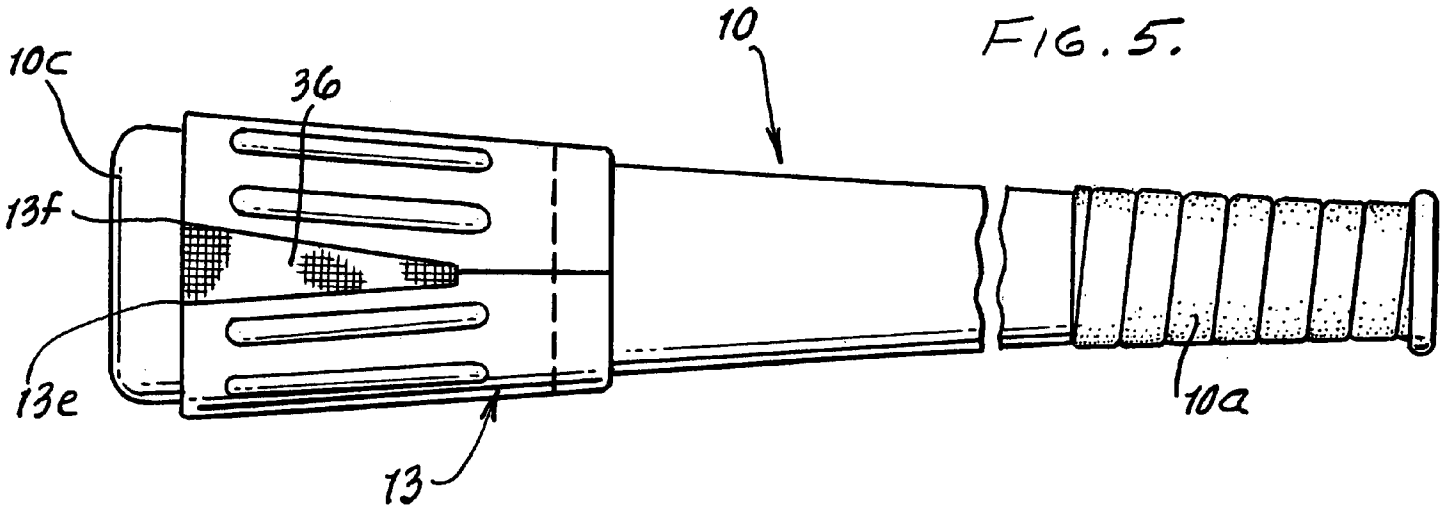
FIG. 5 is a view like FIG. 1, showing another modification.
Figure 6:
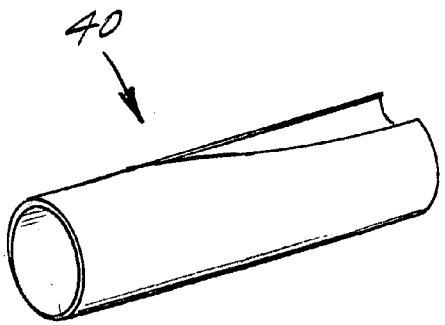
FIGS. 6-9 are three-dimensional views of further modifications.
Figure 7:
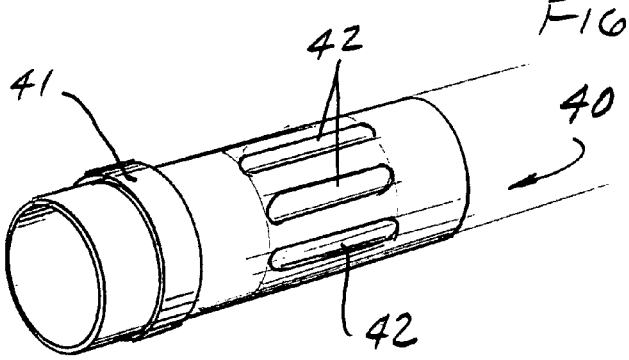
Figure 8:
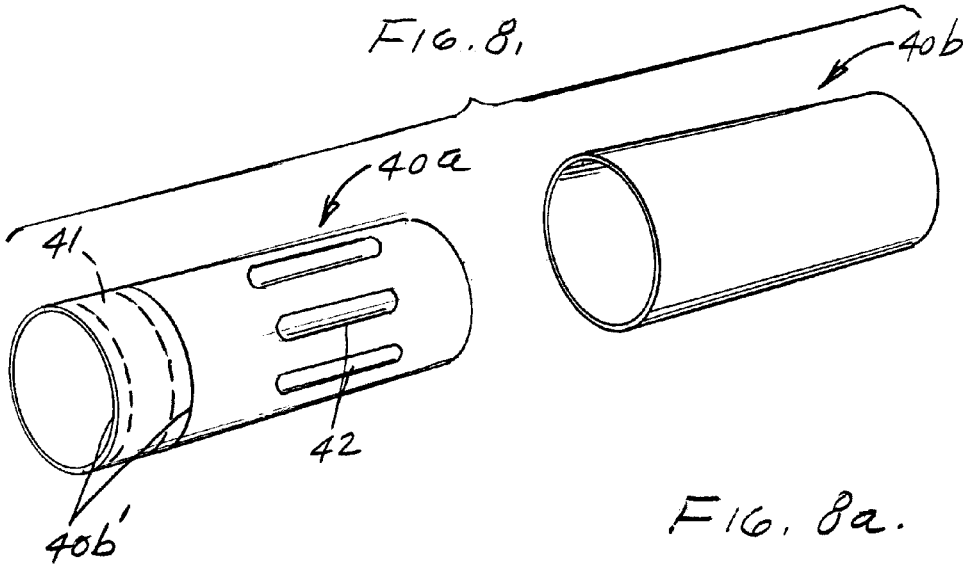
Figure 8A:
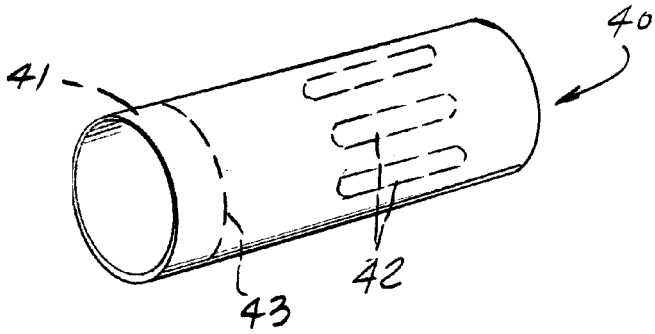

FIG. 5 is a view similar to FIG. 1. The sleeve 13 is split at V-shaped edges 13*e* and 13*f* that extend lengthwise and form a triangle. Stretchable resilient fabric or material such as SPANDEX is provided at 36, and attached to the sleeve along the triangular edges of the sleeve split, of selected length. This allows the sleeve to resiliently expand, for reception on a larger diameter bat, and to fit or adjust to a range of bat diameter sizes.

FIGS. 6, 7, 8 and 8*a* schematically show multiple sections 40*a* and 40*b* of a sleeve assembly 40. Inner sleeve 40*a* carries an annular retainer at 41 and weights at 42. Outer section 40*b* fits telescopically over section 40*a* to form assembly 40. And end portion 40*b*' of 40*a* may be pulled back over the retainer 41 and sewn in position at 43.

Figure 9:
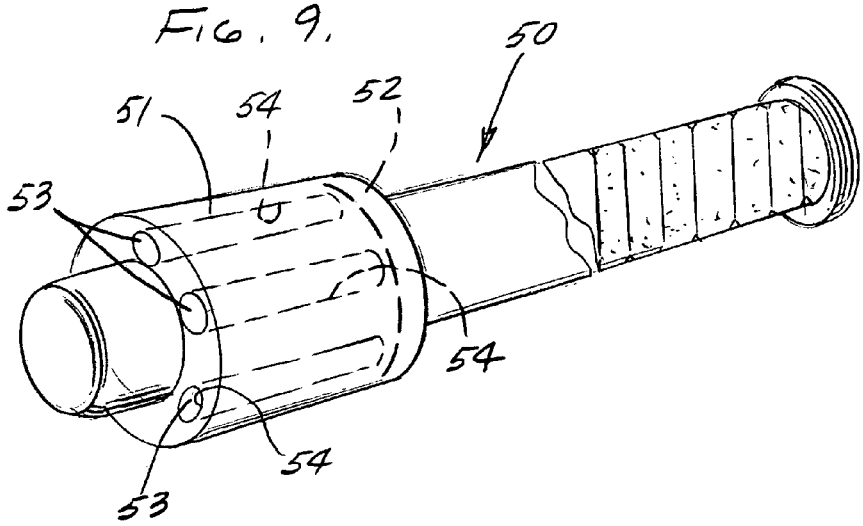

FIG. 9 shows a bat 50, with a thickened sleeve 51 fitting over the bat sweet spot region. A retainer 52 is attached to the sleeve at its end, and may be attached as during molding of the sleeve, as for example if it is made of rubber or plastic. Solid metallic weights 53 fit into pockets 54 in the sleeve itself.

Figure 10:
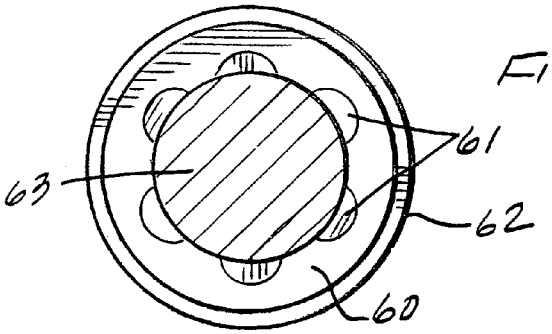
FIG. 10 is a section taken through a modification having inner, outer and intermediate sleeve construction.
Figure 11:
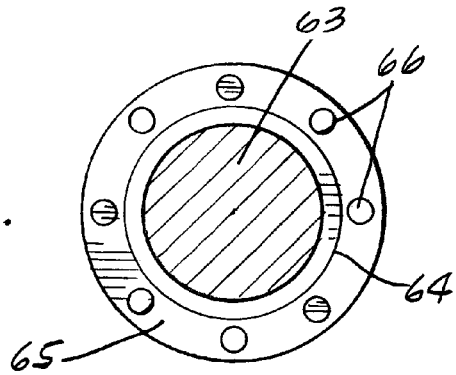
FIG. 11 is a section taken through a modification having inner and outer sleeve construction.

FIG. 10 is a cross section that shows an inner sleeve 60 fitting on a bat and carrying weights at 61; and an outer sleeve 62 fitting over the inner sleeve. The bat is shown in cross section at 63. FIG. 11 shows an inner sleeve 64 fitting on a bat, and an outer sleeve 65 fitting over sleeve 64 and carrying weights at 66. The weights may be carried in pockets in the sleeves. The sleeve carrying the weights may be firm, and the sleeve not carrying weights may be flexible.

Figure 12:
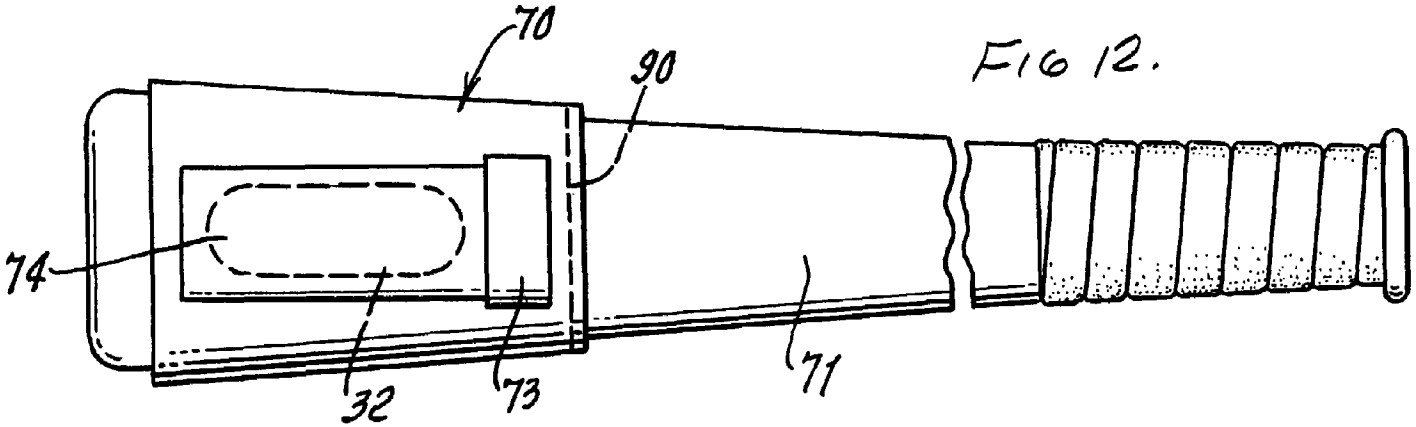
FIGS. 12 and 13 are side views of modifications having different weight position.
Figure 13:
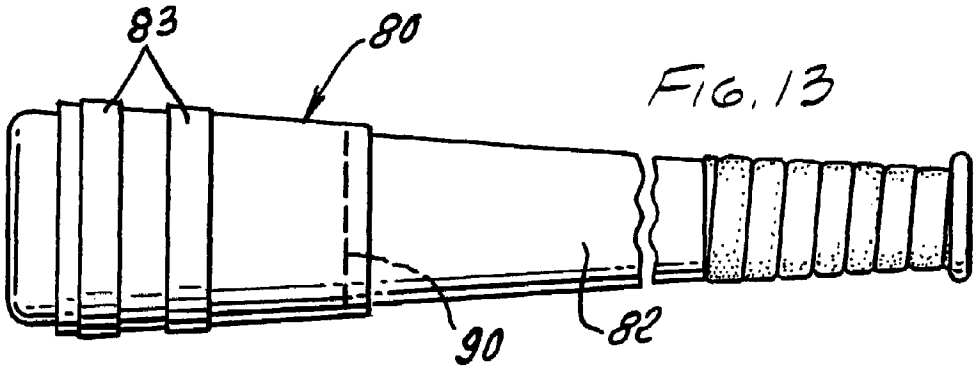

FIG. 12 shows a sleeve 70 on a bat 71, and removable weights 32 carried in pockets 74 that can be opened and closed, as via a flap 73. FIG. 13 shows a sleeve 80 on a bat 82, with weights 83 extending about, or annularly about the bat axis, and carried by the sleeve. See retainers at 90 in FIGS. 12 and 13.

Figure 19:
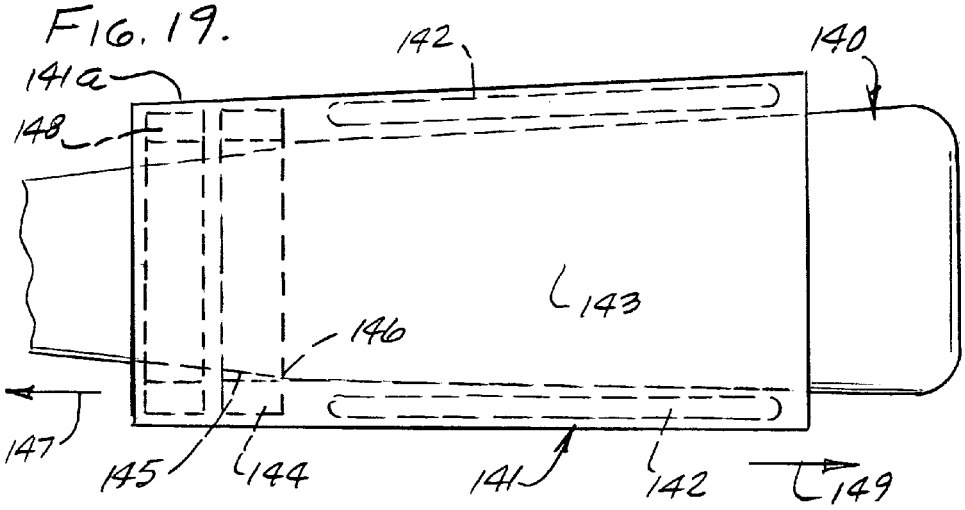

In FIG. 19, bat 140 extends through sleeve 141. Weights 142 are carried by the sleeve as shown, and are spaced about the sleeve axis 143. An annular metallic retainer 144 is carried by the sleeve, and engages the bat tapered surface 145, at annular edge locus 146, to return the sleeve to the bat as during practice swinging. The bat handle extends in direction 147.

Sleeve material 141*a* extends leftwardly beyond the retainer. An insert ring 148 of material is located leftwardly of the retainer, inwardly of material 141*a*. Ring 148 may consist of plastic, and acts as a spacer to keep sleeve end material 141*a* from caving in, or bunching, toward the bat, to interfere with bat separation from the sleeve in direction 149. The sleeve and its end material may be flexible. Ring 148 is typically carried by the sleeve.

In the FIG. 20 modification, elements are as follows:

200—a sleeve with open ends at 200*c* and 200*d*

201—weights carried by the sleeve, and spaced about the sleeve at selected positions. They can be solid, or flowable in plastic or fabric bags, secured to an inner portion of the sleeve.

202—a ring shaped retainer, of any material, or coated with vinyl or rubber, extends about the sleeve near sleeve smaller end 200*d*, to retain the sleeve to the bat, which enters at end 200*c*.

203—Retainer straps that extend crosswise over the retainer, and may be sewed to the sleeve, to position the retainer and hold it in position.

200*a*—Sleeve portion with greater taper than sleeve portion 200*b*.

Figure 21:
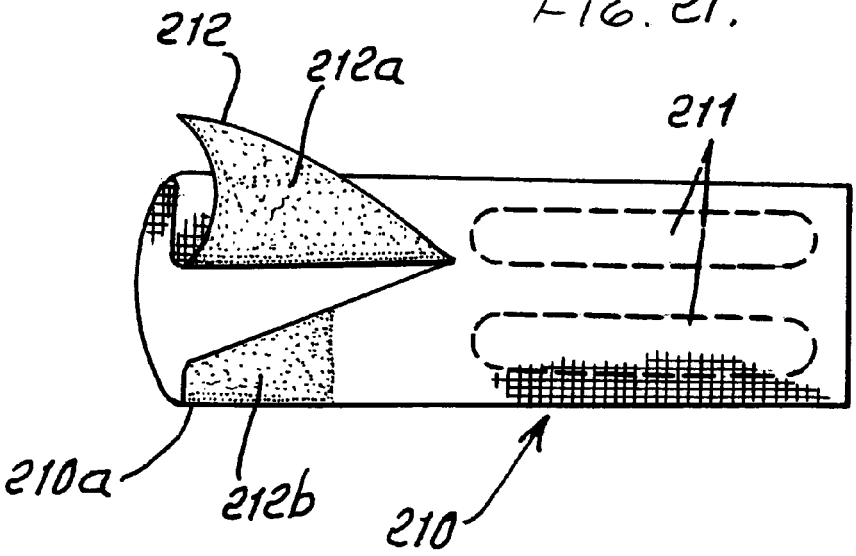

FIG. 21 has the following elements:

210—sleeve

Figure 20:
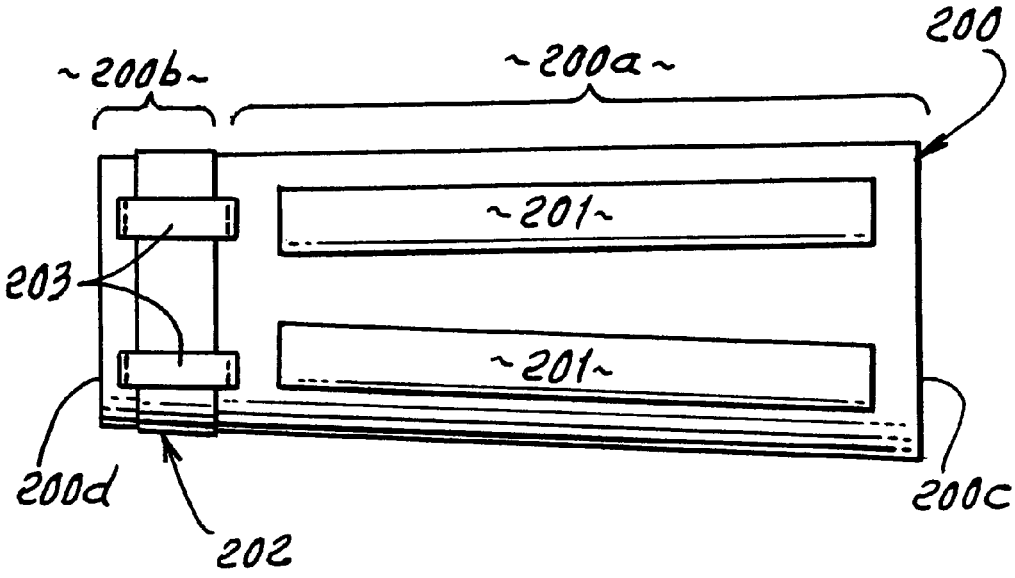
FIGS. 20-27 show modification.

211—weights carried by the sleeve, as in FIG. 20.

212—a flap carrying VELCRO 212*a* (hook or pile)

210*a*—sleeve portion carrying VELCRO 212*b* (pile or hook) to receive adjustable attachment to VELCRO 212*a*, to control the size of the sleeve end portion 210*a* that extends closely about the bat, i.e. is retained to the bat, to retain the sleeve and weights to the bat.

Figure 22:
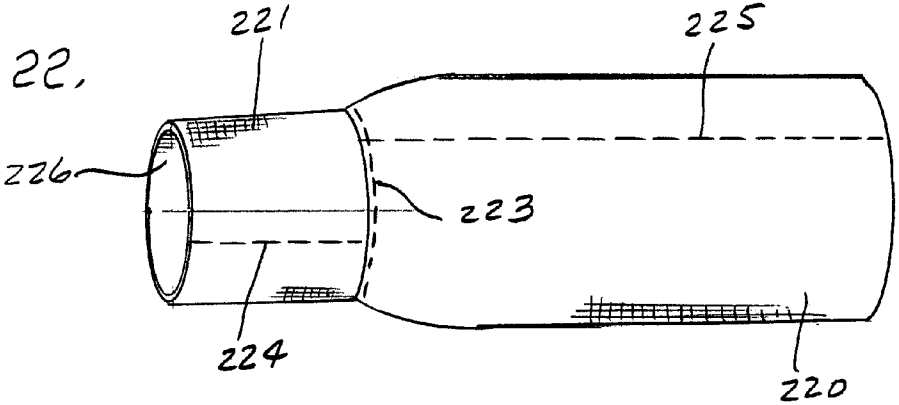

FIG. 22 has the following elements:

220—inner sleeve section of larger diameter to fit various sizes of bat diameters

Figure 23:
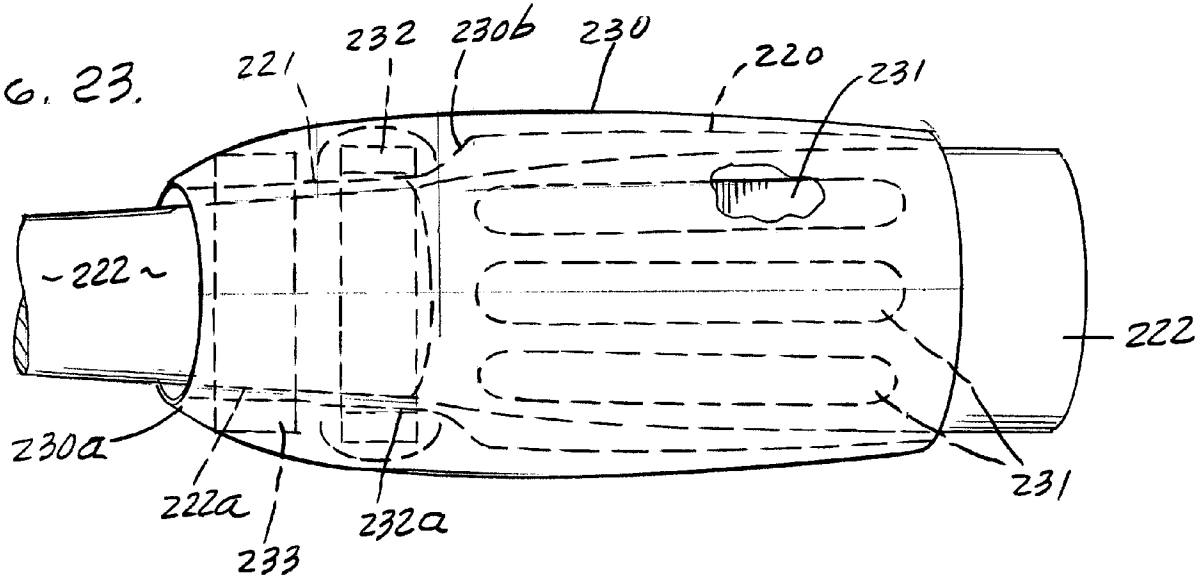

221—inner sleeve section of smaller diameters, to fit over a bat 222 narrower section 222*a* seen in FIG. 23.

223—Sewn together end junctions of 220 and 221. See also sew lines 224 and 225

226—sleeve end opening

FIG. 23 has the following elements:

230—outer sleeve that fits over inner sleeve 220

231—weights associated with the sleeve, and carried by either.

232—Annular retainer, carried by inner sleeve (for example), and having inside wall 232*a*. Retainer can be secured by a fabric piece sewn to inner wall of sleeve.

233—ring of stiff foam or other material, to act as a spacer or positioner for sleeve excess fabric end 230*a*.

230*b*—sleeve inside wall.

Figure 24:
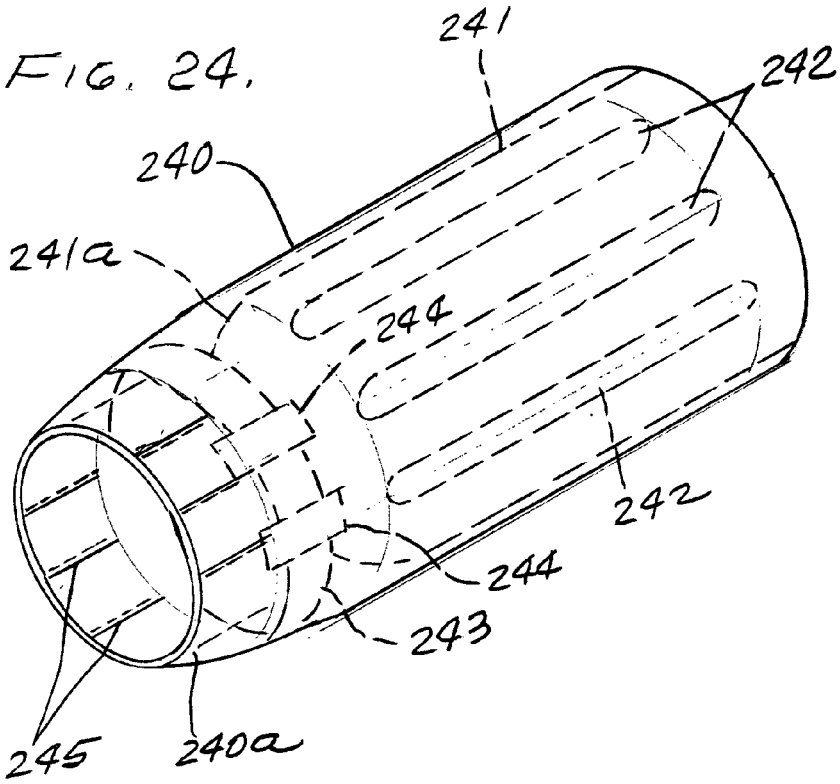

FIG. 24 shows the following elements:

240—outer wall sleeve

241—inner sleeve, with larger diameter section 241*a*

242—weights carried by 240 or 241

243—ring shaped retainer

244—straps sewn over the retainer, and onto either sleeve, to position the retainer. Other retainer holding means can be used.

245—Outer sleeve end slits, sewn together to narrow the sleeve end 240*a* to effectively taper the sleeve to fit a bat taper.

Figure 25:
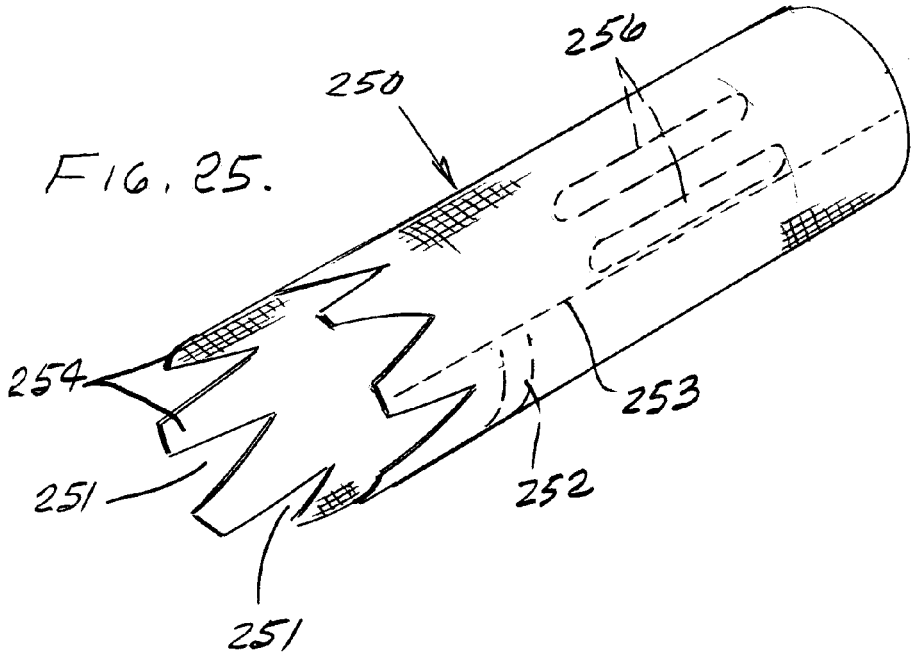

FIG. 25 has the following elements:

250—fabric sleeve

251—cut-outs at one end of 250, to eliminate excess fabric in the retainer area, for example at 252

253—sleeve 250 sew line

Figure 26:
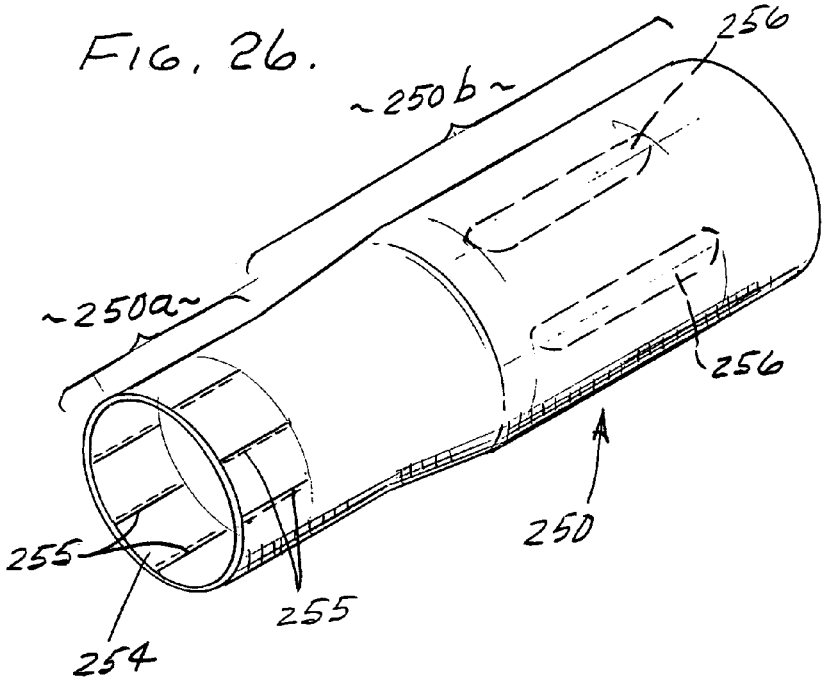

254—sleeve end flaps, between cut-outs, to be sewn together as in FIG. 26.

FIG. 26 has the following elements, associated with FIG. 25:

255—sewn together edges of flaps 254, to provide a reduced diameter sleeve section 250*a*, the larger diameter sleeve section 250*b* fitting many different size bat barrels

256—weights

FIG. 27 has the following elements:

260—open end sleeve or outer sleeve that fits onto a bat 267

261—frame (plastic or metal) associated with or carried by sleeve, to extend about inserted bat

262—weights carried by the frame in pockets 262*a*, and spaced about the bat.

263—sleeve retainer, that extends about the bat, to endwise position the sleeve and frame on the tapered bat, as described above

264—frame ring

264*a*—inside wall

265—open area

266—foam or added plastic sleeve.

FIGS. 28-30 are sections, taken in FIG. 27, and show the positions of weight 262 relative to frame members 261. Zone 271 can be an additional plastic sleeve, extending about the frame. Also, the weight pockets can be spaced about the axis 273, between frame members.

I claim:

1. A bat weight for use on a bat having a knob end, a barrel end opposite the knob end and a taper defined along an outer surface between the knob end and the barrel end, the bat weight comprising:

a) an elongated tubular sleeve comprising a longitudinal axis, a first opening at a first end, a second opening at a second end opposite the first end, a circumferential inner wall surface defined along the longitudinal axis between the first and second ends for positioning adjacent the bat outer surface, and a circumferential outer wall surface defined along the longitudinal axis between the first and second ends for assisting in the gripping and positioning of the sleeve relative to the bat;

b) an enclosed interior defined between the inner and outer wall surfaces from the first end to the second end;

c) an annular retainer ring secured within the enclosed interior proximate the first end for engaging the bat taper upon sliding advancement of the tubular sleeve across the bat outer surface from the knob end to the barrel end, the retaining ring fixing the dimension of the first opening such that the first opening is not adjustable relative to the bat; and d) at least one weight secured within the interior and spaced from the retainer;

e) wherein centrifugal force during swinging of the bat seats the retainer against the bat taper.

2. The bat weight of claim 1, wherein the first opening is smaller than the second opening.

3. The bat weight of claim 2, wherein the tubular sleeve gradually tapers outwardly from the first end to the second end during use and non-use of the sleeve relative to the bat.

4. The bat weight of claim 1, further comprising a plurality of spaced-apart weights.

5. The bat weight of claim 4, wherein the plurality of spaced-apart weights are secured within discrete pockets disposed within the enclosed interior.

6. The bat weight of claim 5, wherein the plurality of spaced-apart weights are deformable.

7. The bat weight of claim 1, wherein the second opening has a fixed dimensions such that the second opening is not adjustable relative to the bat.

8. The bat weight of claim 1, wherein the retainer ring is axially spaced along the longitudinal axis from the first end in the direction of the second end by a distance greater than the thickness of the inner and outer wall surfaces.

9. The bat weight of claim 8, further comprising a spacer ring disposed between the retainer ring and the first end.

10. The bat weight of claim 8, wherein the first end of the sleeve is deformable along the longitudinal axis relative to the retainer ring.

11. The bat weight of claim 10, wherein the at least one weight is spaced from the second end such that the second end is deformable along the longitudinal axis relative to the at least one weight.

12. The bat weight of claim 1, wherein the inner and outer wall surfaces are joined along the first and second ends respectively to form the enclosed interior.

13. The bat weight of claim 1, wherein the elongated tubular sleeve adjacent the second opening is split to form an expandable second opening.

14. A bat weight for use on a bat having a knob end, a barrel end opposite the knob end and a taper defined along an outer surface between the knob end and the barrel end, the bat weight comprising:

a) an elongated sleeve comprising a longitudinal axis, a first opening at a first end, and a second opening at a second end opposite the first end, the first and second openings being continuous during use and non-use of the bar weight relative to a bat;

b) a non-adjustable, annular retainer ring secured to the sleeve proximate the first end for engaging the bat taper upon advancement of the sleeve across the bat outer surface from the knob end to the barrel end;

c) a plurality of removable weights secured around the sleeve, each weight carried in a separate pocket that is opened and closed by a flap, the flap being positioned to open in the direction of first end such that the weight is insertable in the pocket in the direction of the second end, each weight being spaced from the retainer by a flexible portion and in the direction of the second end; and d) a continuous portion respectively defined along the longitudinal axis between each weight and the retainer ring for defining a spaced-apart relation along the longitudinal axis between each weight and the retainer ring, and further comprising an inner surface for positioning adjacent the bat outer surface, and an outer surface;

e) wherein centrifugal force during swinging of the bat seats the retainer ring against the bat taper.

15. A bat weight for use on a bat having a knob end, a barrel end opposite the knob end and a taper defined along an outer surface between the knob end and the barrel end, the bat weight comprising:

a) a sleeve comprising a longitudinal axis, a first opening at a first end, and a second opening at a second end opposite the first end, b) a non-ajustable retainer ring secured to the sleeve proximate to but spaced from the first end along the longitudinal axis for engaging the bat taper upon advancement of the sleeve across the bat outer surface from the knob end to the barrel end, a first flexible region of sleeve material defined between the retainer ring and the first end; and c) at least one weight secured to the sleeve and spaced from the retainer ring along the longitudinal axis;

d) wherein centrifugal force during swinging of the bat seats the retainer against the bat taper.

16. The bat weight of claim 15, wherein the at least one weight is secured proximate to but spaced along the longitudinal axis from the second end by a second flexible region of sleeve material.

17. The bat weight of claim 15, further comprising a plurality of weights secured to the sleeve.

18. The bat weight of claim 15, wherein at least one of the first and second openings has a fixed dimension.

19. The bat weight of claim 15, wherein the retainer ring is spaced along the longitudinal axis from the first end in the direction of the second end by a distance greater than the thickness of the sleeve.

* * * * *